United States Patent [19]

Ranzanigo

[11] 3,936,787

[45] Feb. 3, 1976

[54] CARTRIDGE FUSE CARRIER ASSEMBLY

[75] Inventor: Pierluigi Ranzanigo, Brescia, Italy

[73] Assignee: Bassani S.p.A., Milan, Italy

[22] Filed: Mar. 29, 1974

[21] Appl. No.: 456,278

[30] Foreign Application Priority Data

May 30, 1973 Italy ..... 24840/73

[52] U.S. Cl. ..... 337/228; 337/213;215;236

[51] Int. Cl.[2] ..... H01H 85/14

[58] Field of Search ..... 337/227, 228, 213, 214, 337/215, 236; 317/242

[56] References Cited

UNITED STATES PATENTS

| | | | |
|---|---|---|---|
| 3,299,236 | 1/1967 | Barker | 337/214 X |
| 3,505,630 | 4/1970 | Merrill et al. | 337/228 X |

FOREIGN PATENTS OR APPLICATIONS

| | | | |
|---|---|---|---|
| 1,227,390 | 8/1960 | France | 337/214 |
| 701,047 | 12/1953 | United Kingdom | 337/214 |

*Primary Examiner*—J. D. Miller
*Assistant Examiner*—Fred E. Bell
*Attorney, Agent, or Firm*—Michael J. Striker

[57] ABSTRACT

A cartridge fuse carrier assembly has a housing with a recess for receiving a cartridge fuse. The fuse is held compressedly between a contact member at the bottom of the recess, and a conducting ring carried by a cap at the mouth opening of the recess. The cap carries locking means which are moved into the cap-securing position by a transverse movement of the cap relative to the recess, after the cap has been fitted to the mouth opening of the recess. One of the locking means forms an electrical connection between the mouth opening end of the inserted fuse, and a connection terminal.

8 Claims, 2 Drawing Figures

CARTRIDGE FUSE CARRIER ASSEMBLY

BACKGROUND OF THE INVENTION

Cartridge fuses are often included in circuits for the protection of electrical equipment, for example each phase, including the neutral conductor, of an electrical circuit, can include a cartridge fuse. Such a fuse may be carried in a fuse holder which is an independent unit connected into the circuit to be protected, or in a fuse holder which is combined with for example an electrical switch. In the latter case the fuse may be inserted into a suitable recess or housing provided in the insulating casing of the switch, which may be manual or automatic.

It has been proposed that a cartridge fuse can be secured in the housing by a ring nut which is screw-threadedly fitted onto a screw-threaded ring at the mouth of the housing, the ring nut being tightened on the ring to provide a locking action to secure the fuse in the housing. Tightening of the ring nut also causes a compression force to be applied to the cartridge fuse in the axial direction thereof, to ensure electrical contact and continuity. However, the ring nut is not always capable of maintaining a secure contact with the correct degree of compression of the cartridge fuse, since the ring nut may tend to become slackened. In addition, the production and fitting of a ring nut and a companion screw-threaded ring generally involve substantial cost.

SUMMARY OF THE INVENTION

It is an object of the present invention to provide a cartridge fuse carrier assembly in which a cartridge fuse can be easily fitted into its operative position.

A further object is to provide a carrier assembly which ensures that the compression force applied to the cartridge fuse for the purposes of maintaining electrical contact and continuity, does not become reduced in the course of time.

Yet another object of the invention is to provide a cartridge fuse carrier assembly which does not require the manufacture of complicated components such as screw-threaded members, as in the previously discussed assemblies.

To attain these and other objects, the cartridge fuse carrier assembly of the invention has a housing with connection terminals for connecting the assembly into an electrical circuit. The housing has a recess into which a cartridge fuse can be inserted, a contact member being disposed in the recess, adjacent the closed end thereof, and connected to one of the terminals. One end cap of a cartridge fuse bears against the contact member in the fitted position of the fuse. The open end of the recess is closed by an insulating cap which has an electrically conducting ring with an abutment shoulder which bears against the second end cap of the cartridge fuse, to urge the cartridge fuse against the contact member. The cap has engagement means in the form of lugs, hooks or the like, for securing the cap in position in the opening of the recess, at least one of the engagement means being electrically conducting in order to form an electrical connection between the ring on the cap and the other of the connection terminals of the housing. The cap with cartridge fuse carried thereby is displaced in the axial direction of the recess to bring the fuse into contact with the contact member in the recess, the cap then being displaced in a second direction transversely to the axial direction of the recess, to lock the cap in position. The second phase of movement of the cap, in the transverse direction, can be a rotary movement or a movement perpendicular to the axial direction of the recess.

The engagement means can comprise a generally hook-shaped member on the cap, which is co-operable with a transverse member extending across the opening of the recess, adjacent one side thereof. The cap is displaced laterally of the recess, so that the hook-shaped member engages the transverse member for locking the cap.

The engagement means can also include a tab member projecting substantially radially from the ring in the cap, the tab member being engageable into a slot in an electrically conducting member which is disposed adjacent the opening of the recess, at the side of the recess opposite the above-mentioned transverse member. In this way both the hook-shaped member and the tab member are moved into their position of engagement to lock the cap, by a single lateral movement of the cap.

Although the contact member in the bottom of the recess can be resiliently flexible, to provide the necessary compression force on the cartridge fuse, it is also possible to provide separate spring means to achieve the same effect.

DESCRIPTION OF THE PREFERRED EMBODIMENT

Figure 1:
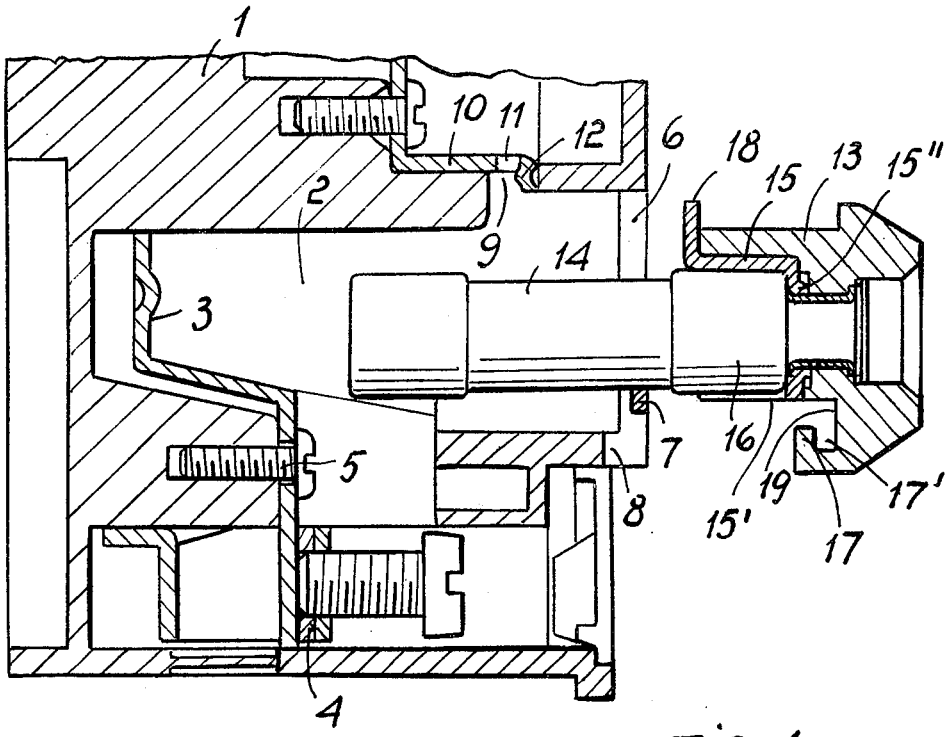
FIG. 1 is a view in cross-section of the carrier assembly, with a cartridge fuse in a partially disengaged position.

Referring now to the drawing, a cartridge fuse carrier assembly comprises a box or housing 1 of insulating material. The box or housing 1 may be the housing of an independent fuse holder, that is to say, a unit whose sole purpose is to incorporate a fuse into an electrical circuit, or it may be a part of the casing of for example a manual or automatic switch, that is to say, a switch and the fuse carrier assembly are combined into a single unit. The housing 1 shown includes an elongated recess 2, although the housing 1 may have a plurality of such recesses where a plurality of cartridge fuses are to be carried by the carrier assembly, for example when it is necessary to include a fuse in each phase conductor line of an electrical circuit to be protected, including the neutral line. As can be seen from the drawing, the recess 2 is closed at one end, being the left-hand end in the drawing.

An electrical contact member or contact means 3 is arranged partly within the recess 2. The contact member 3 is resiliently flexible and is of an angularly bent configuration, including a contact portion adjacent the bottom or closed end of the recess 2, and a portion forming part of a connecting terminal 4. The contact member 3 is secured in the housing 1 by means of a screw 5.

The recess 2 is open outwardly of the housing 1, at the right-hand end in the drawing, by means of an opening 6. A transverse member 7 is disposed across the opening 6, adjacent to and slightly above the bottom edge 8 of the opening 6.

Just inside the opening 6 of the recess 2, and in the side of the recess 2 which is opposite the side thereof terminating at the engaging edge portion 8, is an opening 9. A contact member or contact means 10 extends across the opening 9 as shown, and has a slot 11 which is in line with the opening 9, while one edge portion 12 of the contact member 10 is bent towards the opening 9. The purpose of this arrangement will be apparent hereinafter.

The carrier assembly also comprises fuse cap means 13 made for example of insulating material, for closing the opening 6 of the recess 2. When the cap 13 is fitted into position at the opening 6 of the recess 2, as in FIG. 2, a cartridge fuse 14 will be locked in position in the recess 2, and will be subjected to a compression force in its axial direction.

The cap 13 carries a ring 15 which is made of electrically conducting material. The ring 15 is open at one side as indicated at 15', so as to provide a degree of flexibility in the ring 15, whereby the ring 15 can be slightly increased in its transverse dimension for insertion into the ring of a conducting end cap 16 of the cartridge fuse 14. The end cap 16 will be held in the ring 15 by the clamping action and the frictional engagement thereof.

Figure 2:
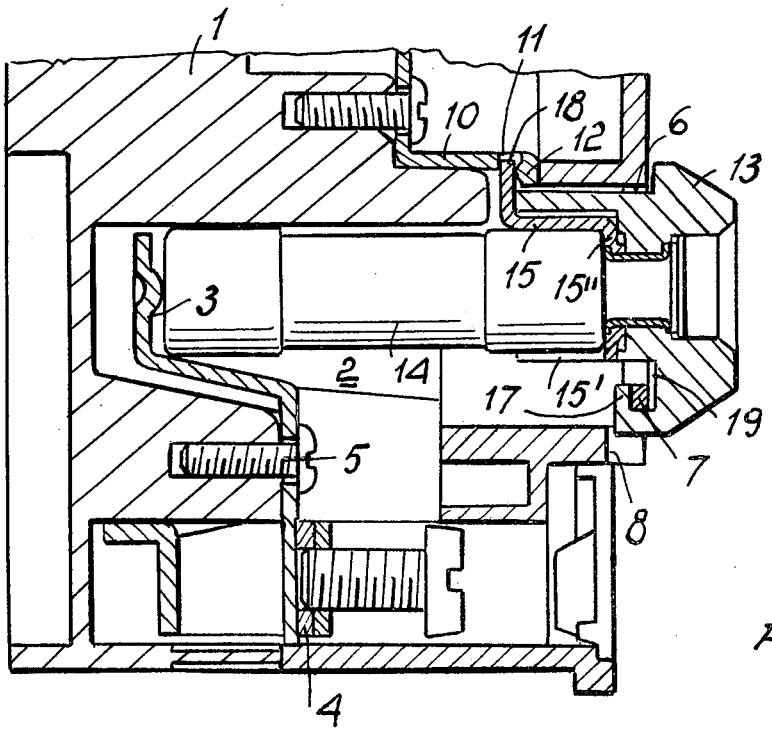
FIG. 2 shows the carrier assembly with the cartridge fuse secured in position therein.

The ring 15 also has an abutment member in the form of a radially extending annular flange or shoulder 15'' against which the end cap 16 of the cartridge fuse 14 will abut, whereby the cartridge fuse is subjected to the above-mentioned axial compression force when it is secured in place in the carrier assembly, as shown in FIG. 2.

The cap 13 also has on one side, being the downwardly facing side in FIGS. 1 and 2, a securing member 17 which is secured to or in one piece with the cap 13. The member 17 is generally hook-shaped as shown, comprising a portion which extends towards the body of the cap 13 from a position laterally spaced from the body of the cap, defining a cavity or recess 17' also delimited by part of surface 19 of the member 17. The arrangement of the member 17 is such that when the cap 13 is fitted into the opening 6 of the recess 2, this being the position shown in FIG. 2, the transverse member 7 fits into the cavity 17', to hold the cap 13 in a locked position.

At its side remote from the member 17, the ring 15 carries a radially projecting lug means or tab 18 arranged to engage into the slot 11 in the contact member 10 to secure the cap 13 in position to close the recess 2. The lug or tab 18 will also bear against the bent edge portion 12 of the contact member 10, as well as extending into the slot 11 (see FIG. 2).

The cap 13 has a small aperture 20 which is covered by a transparent wall portion 21, through which the end cap 16 of the cartridge fuse 14 can be inspected, for possible removal of the fuse.

The cartridge fuse is fitted into the above-described carrier assembly, in the following manner:

The end cap 16 of the cartridge 14 is first fitted into the ring 15 where it is held by the slight compression force of the ring. The end of the cartridge fuse 14 remote from the end cap 16 is then inserted into the recess 2, and the cap 13 with cartridge fuse 14 are moved in the axial direction of the recess 2 until the surface 19 of the hook-shaped member 17 bears against the transverse member 7. In this position of the cap 13, the lug or tab 18 will be in alignment with the slot 11, and the transverse member 7 will be in alignment with the cavity 17'. The end cap of the cartridge fuse which is remote from the end cap 16 will be in a position of bearing firmly against contact portion, in the recess 2, of the contact member 3, since when the cartridge fuse 14 is displaced axially, it presses against the contact portion of the member 3 which is thus resiliently deflected, the resilient deflection thereby producing a compression force in the axial direction on the cartridge fuse.

To lock the cartridge fuse into the housing 1, the cap 13 is then moved transversely of the recess 2, that is to say, in an upward direction as viewed in FIGS. 1 and 2, so that the lug or tab 18 engages into the slot 11 and the transverse member 7 engages into the cavity 17'. The cartridge fuse is now locked in position and held firmly between the shoulder 15'' on the ring 15 in the cap 3, and the contact portion of the member 3.

The cartridge fuse 14 can be removed by reversing the sequence of the above-described operations.

The compression force applied to the fuse by the axial movement into the recess 2 is maintained when the cap 13 is locked by its transverse displacement, as described above. It will be noted that the contact member 10, while being close to the opening 6, is not accessible for fingers or a tool, so that it does not represent an injury hazard, even when connected into the electrical circuit and when the electrical circuit is live. Although the second movement of the cap 13 to lock it in position is described above as being a lateral rectilinear movement perpendicular to the axial direction of the recess, the second movement could alternately be a rotary movement.

It will be noted that the cap 13 is easy to fit and remove and is securely locked when fitted as described above, thereby reducing the danger of accidental removal and exposure of the live contact members.

Although the compression force on the cartridge fuse 14 in the above-described assembly is produced by making use of the inherent flexibility and resiliency of the contact member 3, it would also be possible to provide independent resilient means such as a spring, to produce the compression force.

It will be apparent that various modifications and alterations could be made in the above-described construction without thereby departing from the spirit and scope of the present invention.

What is claimed is:

1. In a fuse assembly for mounting fuses having electrically conductive ends, a combination comprising a housing having an elongated recess for axially receiving a fuse through an opening; a pair of electrical contact means in said recess at longitudinally spaced locations thereof; fuse cap means for engaging one of said ends of the fuse and axially inserting the latter for effecting electrical contact between the other of said ends of the fuse and one of said spaced contact means; and locking means on said fuse cap means in electrically conductive contact with said one end of the fuse and adapted for movement in a direction transverse to said elongation of said recess for effecting electrical contact between said one end and the other of said spaced contact means only subsequent to said electrical contact created by the axial insertion of said fuse cap means.

2. A combination as defined in claim 1; and further comprising resilient means in said recess adjacent one of said ends of said fuse for effecting an axial force on the fuse.

3. A combination as defined in claim 2, wherein said one spaced contact means is flexible and constitutes said resilient means.

4. A combination as defined in claim 1, wherein said fuse cap means comprises a conductive ring mounted on said one end of the fuse, said ring having shoulder abutment means adjacent the axial end face of said one fuse end to prevent axial movement of said fuse out of said recess, and a holder formed of electrically insulating material partially surrounding said ring.

5. A combination as defined in claim 4, wherein said locking means comprises a hook-shaped member having wall portions defining a cavity which extends in said direction transverse to said elongation of said recess.

6. A combination as defined in claim 5, wherein said housing has an engaging portion adapted to abut against said wall portions of said hook-shaped member so as to limit axial insertion by said fuse cap means, and a transverse member extending across said opening of said housing and overlying said cavity when said engaging portion abuts against said wall portions, said transverse member being adapted to fit within said cavity when said fuse is displaced in said transverse direction.

7. A combination as defined in claim 6, wherein said locking means further comprises conductive lug means in electrical contact with said conductive ring and extending radially in said transverse direction, said other of said contact means having a transverse slot adapted to receive said lug means when the fuse is displaced in said transverse direction, said transverse member and said lug means substantially simultaneously engaging said wall portions of said cavity and said transverse slot respectively.

8. A combination as defined in claim 1, wherein said housing is formed of electrically insulating material.

* * * * *